US005992733A

United States Patent [19]

Gomes

[11] Patent Number: 5,992,733

[45] Date of Patent: Nov. 30, 1999

[54] HANDLE ARRANGEMENT FOR A PAPERBOARD CARTON

[75] Inventor: Jean-Manuel Gomes, Marietta, Ga.

[73] Assignee: Riverwood International Corporation, Atlanta, Ga.

[21] Appl. No.: 09/011,670

[22] PCT Filed: Jul. 23, 1996

[86] PCT No.: PCT/GB96/01766

§ 371 Date: May 14, 1998

§ 102(e) Date: May 14, 1998

[87] PCT Pub. No.: WO97/07031

PCT Pub. Date: Feb. 27, 1997

[30] Foreign Application Priority Data

Aug. 15, 1995 [GB] United Kingdom ..... 9516675

[51] Int. Cl.[6] ..... B65D 5/465

[52] U.S. Cl. ..... 229/117.26; 229/117.23; 229/920

[58] Field of Search ..... 229/103.2, 117.22, 229/117.23, 117.26, 920; 206/141, 427

[56] References Cited

U.S. PATENT DOCUMENTS

| | | | |
|---|---|---|---|
| 4,498,619 | 2/1985 | Roccaforte | 229/117.22 |
| 5,328,081 | 7/1994 | Saulas | 229/103.2 |

FOREIGN PATENT DOCUMENTS

| | | | |
|---|---|---|---|
| 0 500 258 A2 | 8/1992 | European Pat. Off. . | |
| 2662141 | 11/1991 | France | 229/117.22 |
| 536 757 | 6/1973 | Switzerland . | |
| 8100090 | 1/1981 | WIPO | 229/117.23 |
| WO 95/11165 | 4/1995 | WIPO . | |
| WO 96/20874 | 7/1996 | WIPO . | |

*Primary Examiner*—Gary E. Elkins
*Attorney, Agent, or Firm*—Womble Carlyle Sandridge & Rice, PLLC

[57] ABSTRACT

There is provided a carton having end panels 13, side panels 15, a top panel 12 and a base. A plastic strap handle 27 is adhesively secured to the two end panels between pairs of cuts 23 which extend across the hinge between the top panel 12 and the end panels 13.

13 Claims, 3 Drawing Sheets

HANDLE ARRANGEMENT FOR A PAPERBOARD CARTON

BACKGROUND OF THE INVENTION

This invention relates to handle arrangements for paperboard cartons, such as fully enclosed cartons, partially enclosed cartons, sleeve type cartons. Such cartons may be used for holding a number of cans, bottles or other articles.

SUMMARY OF THE INVENTION

According to the present invention there is provided a paperboard carton having a top panel, a base panel, two oppositely disposed end panels hingedly connected to said top panel and a separate strap handle extending between the two end panels and being adhesively secured thereto, cuts being provided in each end panel on both sides of the adhesively secured portion of the strap handle, which cuts also extend across the hinges with the top panel and into the top panel.

In preferred arrangements the top panel provides a substantially continuous and uninterrupted surface except for the cuts.

Preferably the pair of cuts in each end panel flare outwardly and downwardly from the hinge with the top panel. Also, the lowermost end of each cut is provided with stress relieving means. In one arrangement the stress relieving means comprises an arcuate end portion of the cut which end portion extends outwardly and upwardly.

A further preferred feature is that the parts of each pair of associated cuts in the top panel are substantially parallel. Also further stress relieving means is also provided at the ends of the cuts in the top panel.

In one such arrangement said further stress relieving means is in the form of the end of the cuts curving outwardly.

Another feature is that between each pair of cuts in the top panel is a transverse fold which is parallel to and is spaced from the hinge between the associated end panel and the top panel.

In preferred arrangements the handle is in the form of a parallel sided strip of plastic or paperboard and the carton is in the form of a fully enclosed carton incorporating side panels. A further feature is that the adhesive for the handle extends up to the junction of the end panels and the top panel and the cuts include frangible connections which break in use of the carton so that the cuts extend their full length when the handle is used.

Embodiments of the present invention will now be described in more detail. The description makes reference to the accompanying drawings:

DETAIL DESCRIPTION

Figure 1:
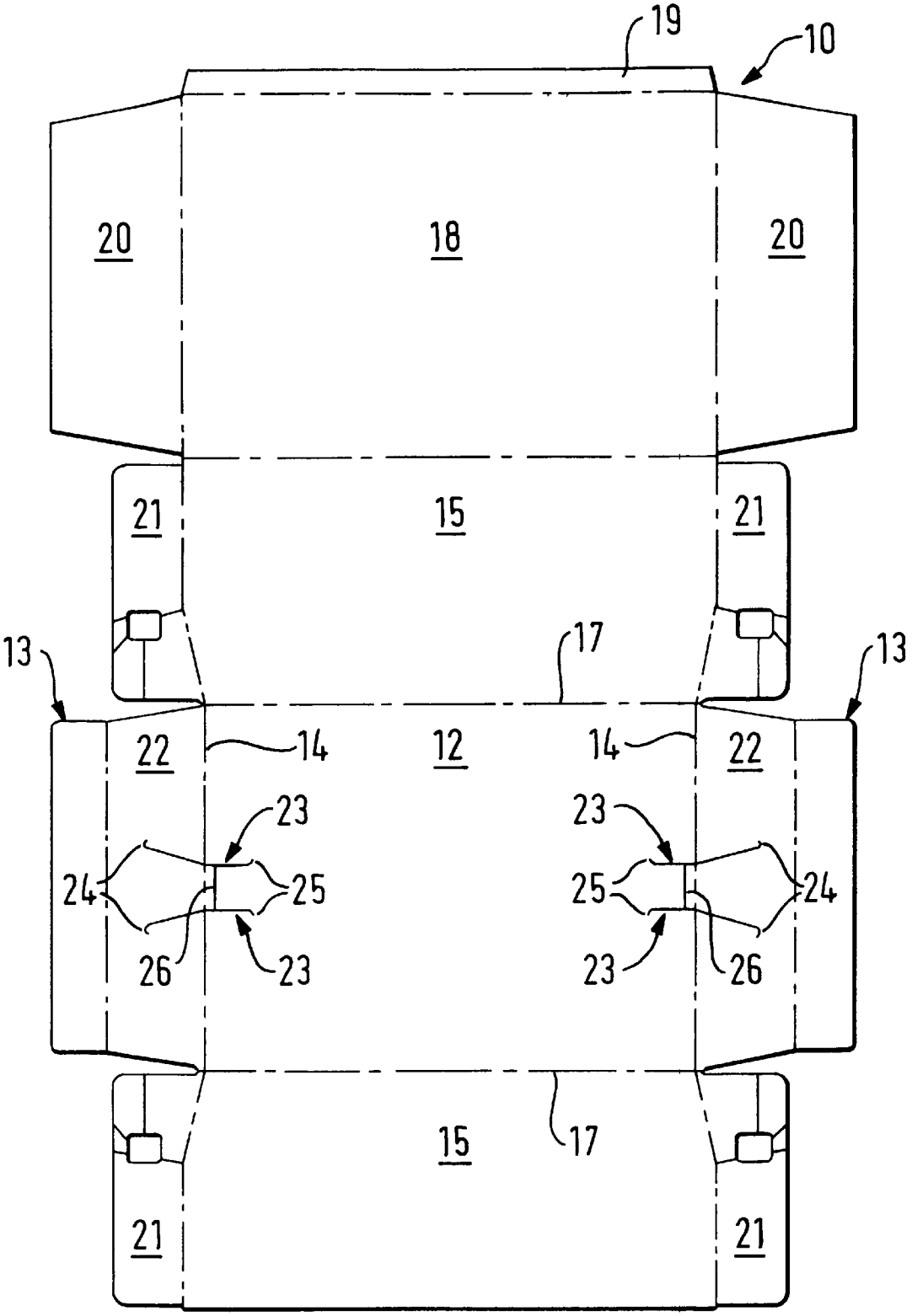
FIG. 1 shows a paperboard blank for forming a carton.

In the figures there is shown a blank 10 for forming a carton 11 for receiving therein an article or a number of articles such as cans or bottles. The blank 10 has a top panel 12, oppositely disposed end panels 13 hingedly connected to the top panel 12 at folds 14 and oppositely disposed side panels 15 hingedly connected to the top panel 12 at folds 17. A base panel 18 and an overlapping adhesive panel 19 are also provided as well as base closure flaps 20 and side closure flaps 21. When folded and secured together the blank produces the generally rectangular cuboid carton 11, although the upper parts 22 of the end panels 13 are angled slightly inwards in the arrangement shown. In other arrangements the upper parts of the side panels 15 could be angled inwards.

Spanning each fold 14 between the top panel and its associated end panel 13 is a pair of cuts 23. The pair of cuts 23 are centrally disposed along the fold 14 and extend parallel to each other in the top panel and flare outwardly and downwardly from the fold 14 in the end panel 13.

Apart from the cuts 23, the top panel 12 provides a continuous, uninterrupted surface which is particularly suitable for printing and which has no joins.

The lower ends of the cuts 23 in each end panel 13 are provided with stress relieving means 24 which in this embodiment comprise arcuate continuations of the cuts 23 extending outwardly and upwardly. Other stress relieving measures could be used as well as or in place of these continuations. Further stress relieving means 25 are also provided at the free ends of those parts of the cuts 23 in the top panel 12. This further relieving means 25 comprises the ends of the cut terminating in an outwardly extending arcuate continuation. The stress relieving means 24, 25 reduce the tendency for the paperboard to tear.

A further fold 26 is provided between the cuts 23 in the top panel 12 and is spaced from and is generally parallel to the fold 14. The fold 26 may comprise a partially cut line rather than a fold as such in the blank 10, the partially cut line forming a hinge when the carton 11 is used.

Figure 2:
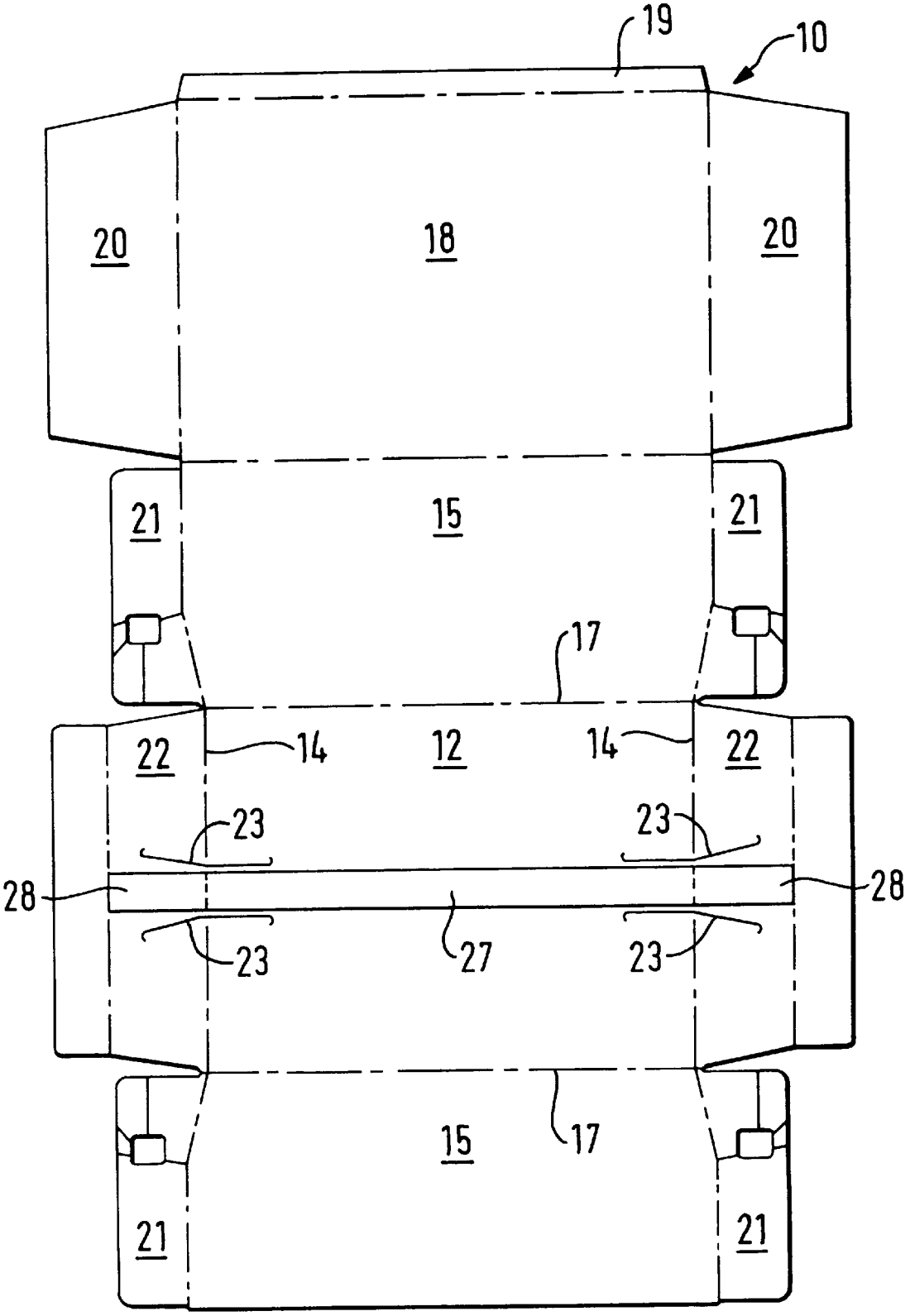
FIG. 2 shows the FIG. 1 blank with a handle member attached.
Figure 3:
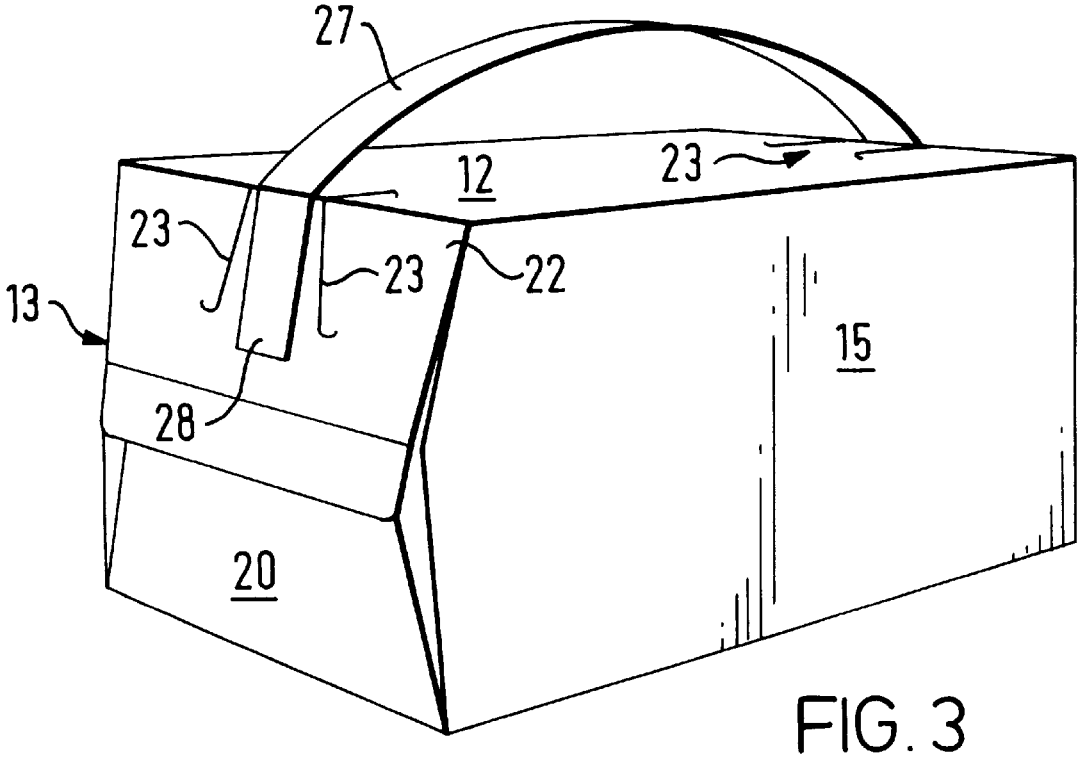
FIG. 3 is a perspective view of the FIG. 2 arrangement assembled.

As shown in FIG. 2 a strap handle 27 extends between the two end panels 13 and is adhesively secured thereto by areas 28. These areas 28 are only on the end panels 13 and not on the top panel 12. Also the areas 28 are located substantially centrally between the cuts 23. The strap handle 27 may be made of any suitable material such as plastic or paperboard and may be applied at any stage of production of the carton 11 or blank 10 using adhesive or adhesive tape. For example the handle 27 could be attached after the carton 11 has been assembled and filled with articles or the handle 27 could even be applied to the paperboard before the blank 10 has been cut.

Figure 4:
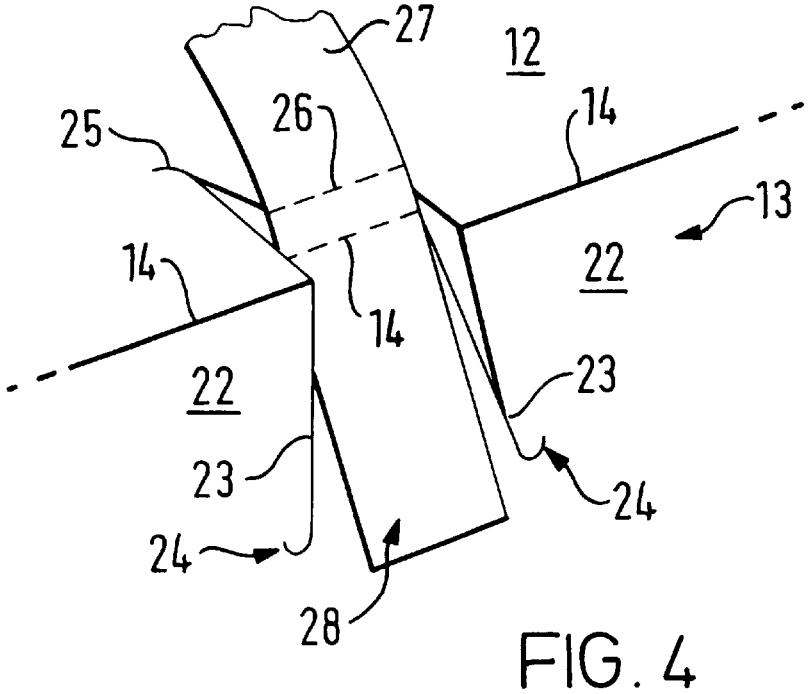
FIG. 4 is an enlarged perspective view of part of the FIG. 3 assembly from another angle with the assembly being lifted by the handle.

After the carton 11 is assembled and the handle 27 is applied, then the carton can be lifted by the handle 27. When lifted by the handle the areas of the end panels 13 between the cuts 23 tends to deflect inwardly and the parts of the top panel between the cuts 23 tends to deflect upwardly and initiate a hinge at the further folds 26 rather than the part of the folds 14 between the cuts 23. This is more clearly shown in FIG. 4. It has been found that the above arrangement is resistant to tearing and also gives the carton stability whilst being carried. In addition the movement between the cuts 23 on lifting also results in more room for the user's hand under the strap handle 27 when in use.

It will be appreciated that the orientation of the pack could be altered without affecting the fundamental operation. For example the handle could be provided on a side panel such that in use that side panel effectively becomes the top panel. Also it will be understood that the concept could be applied to cartons of any shape or size as long as the carton is balanced when it is being carried by the handle.

It will also be apparent that the cuts 23 may not be complete along their length during manufacture. There may be some frangible connections which are broken when the carton is lifted by the handle. Also the shape of the cuts 23 which span the folds 14 could be altered although the cuts 23 must be on both sides of the adhesively secured areas 28 of the handle 27.

While a preferred embodiment of the invention has been disclosed in the foregoing specification and drawings, it will be understood by those skilled in the art that variations and modifications thereof can be made without departure from the spirit and scope of the invention as set forth in the following claims.

I claim:

1. A carton, comprising:

a top panel;

two oppositely disposed end panels, each of said end panels being hingedly connected to said top panel at a respective hinge line;

a strap handle secured to each end panel;

each of said end panels having a pair of cuts therein, each cut of each said pairs of cuts being respectively on each side of said strap handle, each said cut extending across a respective one of said hinge lines and into said top panel; and said top panel being provided with a transverse fold located between one of said pairs of cuts, said transverse fold being spaced from, and extending substantially parallel to, said hinge line.

2. The carton as claimed in claim 1, wherein said top panel defines a substantially continuous and uninterrupted surface.

3. The carton as claimed in claim 1, wherein each of said cuts flares outwardly and downwardly as it extends from said hinge line into one of said end panels.

4. The carton as claimed in claim 1, further comprising stress relieving means provided at a lowermost end of each of said cuts.

5. The carton as claimed in claim 4, wherein said stress relieving means comprises an arcuate end portion extending outwardly and upwardly.

6. The carton as claimed in claim 1, wherein said portions of said pair of cuts are substantially parallel to one another.

7. The carton as claimed in claim 4, further comprising further stress relieving means provided at respective ends of said portions of said cuts.

8. The carton as claimed in claim 7, wherein said further stress relieving means comprises an end portion curving outwardly.

9. The carton as claimed in claim 1, wherein said handle comprises a parallel sided strip.

10. The carton as claimed in claim 9, wherein said handle is secured to said regions of said end panels by adhesive extending up to said hinge lines.

11. The carton as claimed in claim 1, further comprising frangible connections spaced along said cuts, said frangible connections breaking when said handle is pulled upwardly, thereby extending said cuts to their full length.

12. The carton as claimed in claim 1, further comprising opposed side panels connected to said top panel.

13. A blank for producing a carton, comprising:

a top panel;

two oppositely disposed end panels, each of said end panels being connected to said top panel at a respective hinge line;

a strap handle secured to each end panel;

each of said end panels having a pair of cuts therein, each cut of each said pairs of cuts being respectively on each side of said strap handle, each said cut extending across a respective one of said hinge lines and into said top panel; and said top panel being provided with a transverse fold located between one of said pairs of cuts, said transverse fold being spaced from, and extending substantially parallel to, said hinge line.

* * * * *